United States Patent [19]

Cecchi et al.

[11] 4,172,688

[45] Oct. 30, 1979

[54] DEVICE FOR ANTI-ROLLING SIGNALLING FOR CABLE LAYING TRACTORS

[75] Inventors: Carlo Cecchi; Roberto D. Pescarmona, both of Turin, Italy

[73] Assignee: Fiat-Allis Macchine Movimento Terra S.p.A., Lecce, Italy

[21] Appl. No.: 848,861

[22] Filed: Nov. 7, 1977

[30] Foreign Application Priority Data

Nov. 26, 1976 [IT] Italy ..... 69825 A/76

[51] Int. Cl.[2] ..... B66F 11/00

[52] U.S. Cl. ..... 414/747; 73/143; 116/284; 212/39 MS; 177/147; 340/685; 414/698

[58] Field of Search ..... 214/1 PA, 761; 212/39 R, 39 A, 39 MS; 340/267 C; 37/DIG. 19; 116/124 F, 129 F; 177/147; 73/143

[56] References Cited

U.S. PATENT DOCUMENTS

| | | | |
|---|---|---|---|
| 2,022,844 | 12/1935 | Christian | 340/267 C X |
| 2,983,140 | 5/1961 | Crane | 73/143 |
| 3,187,913 | 6/1965 | Strader et al. | 214/761 |
| 4,042,116 | 8/1977 | Bertolino | 214/1 PA X |
| 4,112,750 | 9/1978 | Murakami | 177/147 X |

FOREIGN PATENT DOCUMENTS

| | | | |
|---|---|---|---|
| 389929 | 3/1933 | United Kingdom | 177/147 |

*Primary Examiner*—L. J. Paperner

*Attorney, Agent, or Firm*—August E. Roehrig, Jr.; Robert A. Brown; Harvey W. Rockwell

[57] ABSTRACT

A signalling device operatively coupled between the side arm or lifting boom of a pipe layer and the frame thereof in a predetermined fixed position such that movement of the signalling device relative to the fixed position, which occurs in response to the operational load, is directly related to the critical or rolling load for any lateral position of the side arm or lifting boom.

12 Claims, 7 Drawing Figures

DEVICE FOR ANTI-ROLLING SIGNALLING FOR CABLE LAYING TRACTORS

BACKGROUND OF THE INVENTION

This invention relates in general to signalling apparatus, and in particular, to a signalling device for indicating maximum applied operational loading conditions.

More specifically, but without restriction to the particular use which is shown and described, this invention relates to a signalling device for indicating an applied loading condition as a percentage of a maximum operational loading condition which is especially suitable for use in pipe-laying machinery to directly relate the operational forces applied to a pipe-laying boom regardless of the lateral position of the boom relative to the pipe layer.

In the operation of construction machinery equipment of the type referred to as pipe layers which may, for example, be either of the crawler or wheeled tractor type, a lifting crane including a lifting boom is articulated about a pivot axis carried by the tractor frame. A cable connected hook or other suitable connector is used to hold and lift a pipe coupled about the upright end of the boom through a pulley arrangement which allows the hook-connected pipe to be raised or lowered in response to the operation of a winch carried by the tractor. A second cable is connected to the upright end of the boom and passes about an idler pulley to a second winch carried by the tractor frame so that the boom may be pivoted about the pivot axis to effect lateral movement of the pipe.

Because of the danger to the machine operator and those working about the machine if the pipe layer were to be pulled over during pipe-laying operation, various signalling devices have been developed to alert the machine operator to conditions which indicate approach to a potentially dangerous situation. Generally, these devices signal the operator the possibility of the pipe layer overturning during various operational conditions whenever a critical or overturning load is reached. Some such devices compare the tension in the cable coupling the pipe to the tractor frame with a predetermined referenced value which represents a percentage of the critical rolling load corresponding to each lateral position of the side boom arm. When the reference load or tension is reached, an alarm is sounded to indicate the approach of the critical rolling load. While such devices are helpful to a limited degree, they have the shortcoming of signalling the machine operator only when a certain load value has been exceeded without allowing the machine operator to follow the increase and decrease of the tension applied through the cable. In addition, since dynamic and static loading conditions can differ greatly, the reference value equated through the cable tension is kept substantially below the critical rolling load to prevent the critical rolling load from being exceeded to compensate for inertia which occurs when the load is applied with varying speeds.

Another type of signalling device for pipe layers employs a coincidence type device which detects the position of the side arm or boom and compares the boom position with a value for the critical rolling load corresponding to every such position. This device is excessively complex in its application to the system, and requires that the particular load being lifted by the pipe layer be determined. This determination is extremely inconvenient in field operation due to variations in the load from materials which may accumulate in the pipe and which may vary during movement of the pipe while it is being placed into a trench.

SUMMARY OF THE INVENTION

It is, therefore, an object of this invention to improve signalling devices for indicating approach of a critical loading condition.

Another object of this invention is to improve signalling devices for pipe-laying machinery.

A further object of this invention is to allow the operator of pipe-laying equipment to control the operative loading conditions of the pipe layer in response to the approach of a critical loading condition.

Still another object of this invention is to improve signalling devices for use with pipe-laying equipment by comparing the operational load to a critical or rolling load condition independent of the position of the side lifting arm or boom.

These and other objects are attained in accordance with the present invention wherein there is provided a signalling device operatively coupled between the side arm or lifting boom of a pipe layer and the frame thereof in a predetermined fixed position such that movement of the signalling device relative to the fixed position, which occurs in response to the operational load, is directly related to the critical or rolling load for any lateral position of the side arm or lifting boom.

DESCRIPTION OF THE DRAWINGS

Further objects of the invention, together with additional features contributing thereto and advantages accruing therefrom, will be apparent from the following description of a preferred embodiment, and a variant thereof, of the invention, which is shown in the accompanying drawings with like reference numerals indicating corresponding parts throughout, wherein.

DESCRIPTION OF A PREFERRED EMBODIMENT

Figure 1:
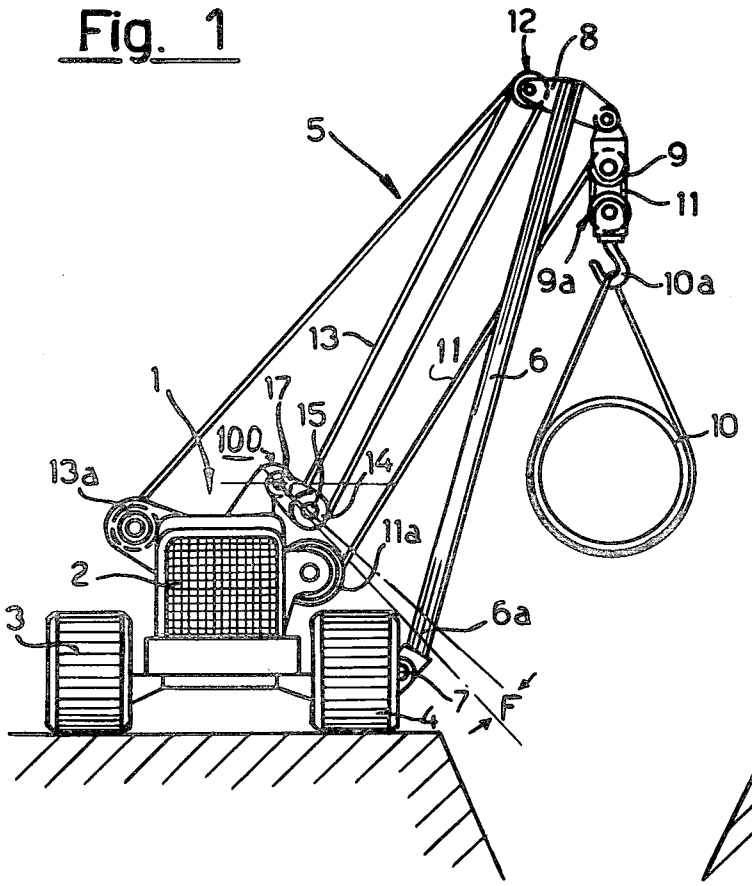
FIG. 1 is a front profile view of a mechanical schematic representation of a pipe layer of the crawler tractor type provided with a representation of the anti-rolling signalling device according to this invention.

Referring now to FIG. 1, there is shown a pipe layer 1 of the crawler tractor type comprising a tractor body and frame 2 supported by a pair of endless tracks 3 and 4. A lifting arm 5, which includes a boom arm 6 having a base 6*a* pivotally connected to the tractor 1 about a pivot axis 7, is secured to the tractor 1 to effect lifting of a pipe 10. The boom arm 6 has at its opposite upper or free end a frame 8 carrying a group of pulleys 9 utilized to effect raising and lowering of the pipe 10. A cable 11 is secured at one end to a tractor supported winch 11*a* and passes about the pulleys 9 and a second group of pulleys 9*a* which support, through a hook 10*a*, the cable secured pipe 10. Operation of the winch 11*a* controls raising and lowering of the pipe 10 through the interconnected pulleys 9 and 9*a*.

A second cable 13, utilized to move the boom arm 6 about the pivot axis 7, extends from a tractor supported winch 13*a* into operative connection with a group of pulleys 12 carried by the boom frame 8 and a group of return pulleys 14 which are supported by the tractor and are utilized in the anti-rolling signalling device 100. Operation of the winch 13*a* controls lifting and lowering of the boom arm 6 about the pivot axis 7 to effect lateral movement of the pipe 10.

The return pulleys 14 are rotatable about an axis of rotation 15 and are carried upon a pivotal crank structure 16. The crank structure 16 is pivotal about an axis of rotation 17 which is parallel both to the pulley axis 15 of the return pulleys 14 and the pivot axis 7 of the lifting boom 6. While the distance between the axes 15 and 17 is greatly enlarged in FIGS. 1, 6 and 7 to better illustrate the principles of operation of the anti-roll signalling device 100, in actuality the distance between these axes is much smaller as shown in the actual embodiment illustrated in FIGS. 2–5. Referring to FIGS. 2–5, the return pulleys 14 are rotatably supported about a pivot pin 19 on bearings 18 such that the axis of the pivot pin 19 coincides with the axis of rotation 15 of the return pulleys. The crank structure 16 includes two shaft portions 20 extending outwardly on both sides of the pivot pin 19 with their center line offset in an eccentric position therewith. The shafts 20 are rotatably supported in the tractor frame 2 by means of support bearings 21 such that the axis of rotation of the support shafts 20 forms an oscillation or pivot axis 17 of the crank structure 16.

Each of the support shafts 20 and the pivot pin 19 is formed as a hollow cylinder with an opening 22 extending therethrough, the center line of which coincides with oscillation axis 17. A cylindrical torsion rod 23, which functions as a torsion spring in a manner to be hereinafter described in detail, extends through the opening 22 with the center line coincident therewith. One end, 23*a*, of the rod 23 fixedly engages one of the support shafts 20 through a spline coupling 24. An opposite end, 23*b*, of the rod 23 extends out from the crank structure 16 and is fixed to the tractor frame 2 through a second spline coupling 25. In this manner, the torsion rod 23 will resist rotation of the crank structure 16 about the oscillation axis 17, thereby functioning as a torsion bar or spring.

At the end 23*a* of the torsion bar 23, which is fixed to one of the shafts 20 and, therefore, free to turn in bearings 21 twisting about its common axis 17, there is fixed one end of a linkage rod 34. An opposite end of the linkage rod 34 is pivotally connected about a pivot pin 35 to a pivot strut 26 which is in turn connected by a pin 27 to a U-shaped plate 28 rigidly fixed to the pin 27. The U-shaped plate 28 is carried within a box 31 on a pivot pin 29 both of which are fixedly secured on the tractor frame 2. A small flat indicator plate 30, shaped like a circular sector and having a radially extending edge 33, is rigidly secured to the U-shaped plate 28 for rotational movement therewith. The circular sector shaped plate 30 is also positioned within the box 31 which is closed by a lid 31*a* having an opening or aperture 32 formed therein. An angular scale with progressive numbers increasing up to a maximum of 100 is inscribed about the periphery of the opening 32 in the lid 31*a*. The radial edge 33 of the circular sector plate 30 is positioned adjacent to the aperture 32 and functions as an index from which a machine operator may read the graded scale as the edge 33 moves relative thereto.

Figure 6:
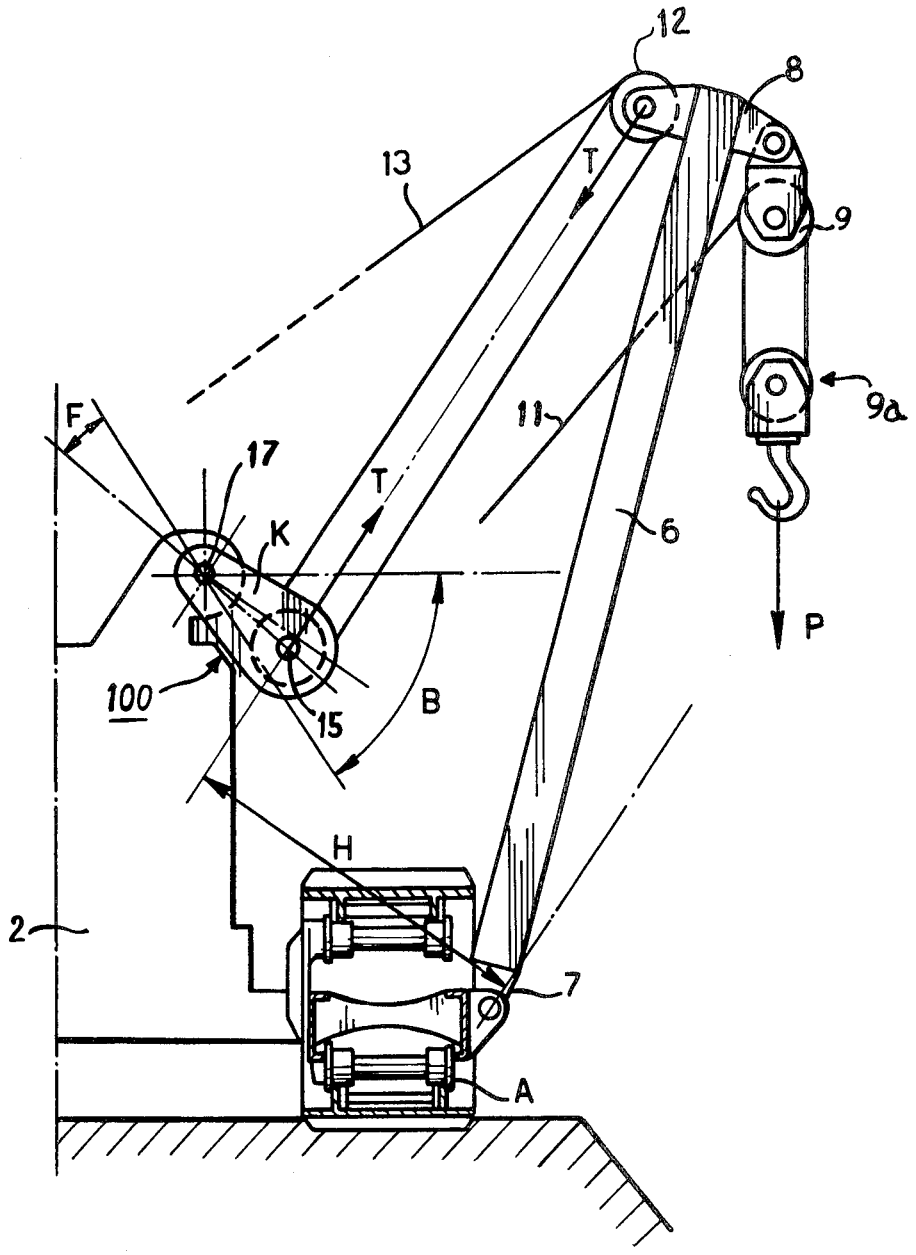
FIG. 6 is a mechanical schematic and force diagram of a portion of the crawler tractor shown in FIG. 1 to illustrate the principles of operation of the anti-rolling signalling device.

Referring now to FIG. 6, the operation of the anti-rolling signalling device 100 will be explained in more detail with reference to the mechanical schematic and force diagram illustrated therein. The force transmitted to the side boom 6 when lifting a pipe 10 is indicated by P and the resultant force which cable 13 transmits to the axis of rotation 15 of the return pulleys 14 is indicated by T. In FIG. 6 the force T is directed along the line which joins the axes of the group of pulleys 12 and 14, which is not precisely exact but, in engineering practice is considered acceptable. The offset distance between the center line 17 of the crank structure 16 and the center line 15 of the return pulleys 14 is greatly exaggerated for convenience of illustration and identified by reference K.

Figure 2:
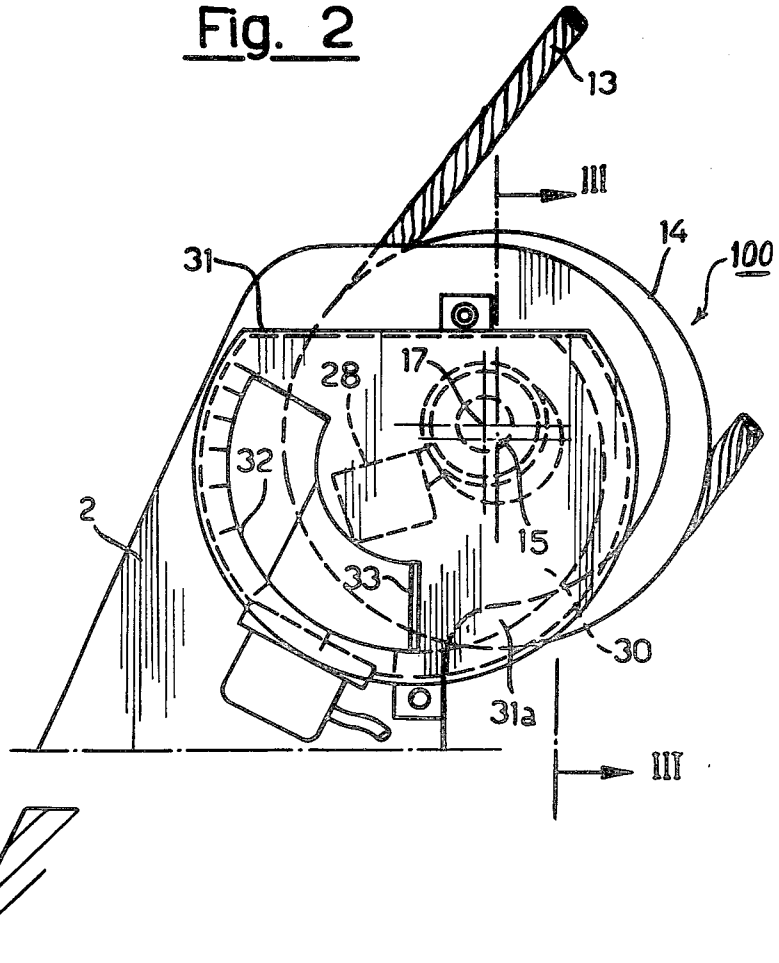
FIG. 2 is a front profile view of the anti-rolling signalling device constructed in accordance with the invention.
Figure 3:
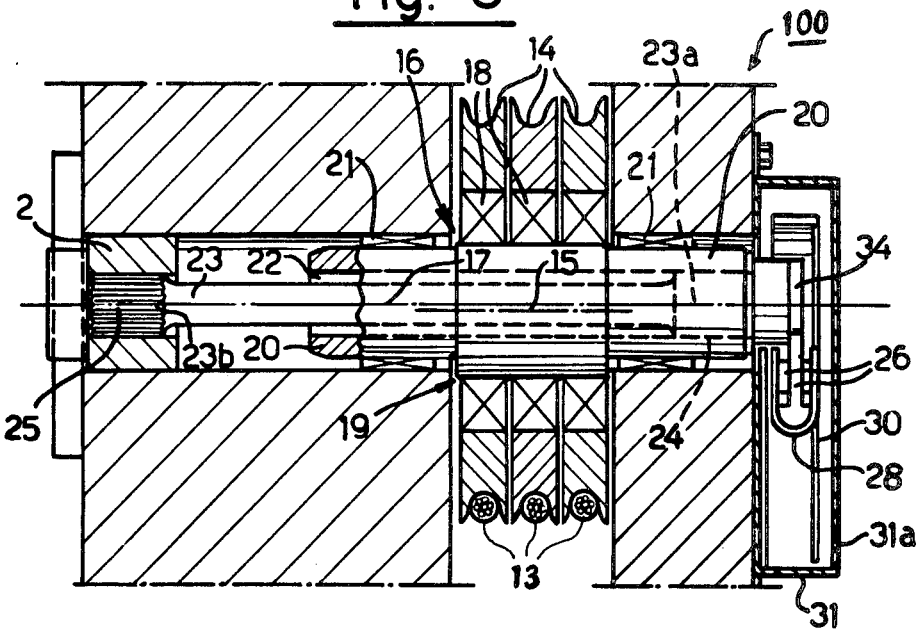
FIG. 3 is a sectional view of the apparatus disclosed in FIG. 2 taken along lines 3—3.

Force T is such as to balance the force exerted on the lift boom 6 by the normal operational load force P such that the moment exerted about the pivot axis 7 of the boom arm 6 by force P and by force T are substantially equal. Force T is also the force which acts on the group of return pulleys 14 to effect pivoting of the axis of rotation 15 of the pulleys about the center line 17 of the crank structure 16. Since the torsion bar 23 is fixed to the tractor frame 2 at one end, pivoting of the axis of rotation 15 of the pulleys 14 about the center line 17 of the crank structure 16 will twist the torsion bar 23 through an angle F which is proportional both to the resultant force T and the distance K, between the center line 15 of the return pulleys 14 and the center line 17 of the crank structure 16. As previously stated, to best illustrate this principle, the distance K illustrated in FIG. 6 is substantially increased from the actual distance between the center lines 15 and 17 as illustrated in FIGS. 2 and 3. Distance H represents the distance between the pivot axis 7 of the boom 6 and the effective application of the resultant force T applied to the return pulleys 14.

Rolling of the pipe layer occurs when the crawler tractor 1 is rotated about a longitudinal axis which extends close to the outside edge of the track supporting roller on the lower part of the endless track and indicated in FIG. 6 as point A. During rolling, in fact, the endless track becomes separated from the track rollers behaving therefore as if it were free in respect to the latter. The turning moment arm about the longitudinally extending axis A is constant as it depends only on the characteristic dimensions of the tractor. The critical or overturning moment occurs as the pivot axis 7 of the lifting boom 6 is approaching or lies in a plane extending parallel to the tractor support surface and passing through the rolling axis A and is, due to the relatively close proximity of pivot 7 and axis A, approximately equal to the moment exerted by a critical rolling load P about the pivot axis 7. In rolling conditions, therefore, the moment exerted by a critical load P about the pivot axis 7 of the lifting boom 6 can be determined independently of determining the angular position of the lift boom 6 relative to the tractor 1. Since the forces exerted on the lift boom 6 must balance, this moment, prior to rolling, must be equal to the moment exerted by the resultant forces T about the pivot axis 7. The resultant force T, therefore, in the rolling or critical conditions, is inversely proportional to the distance H. Because this distance varies with the position of the boom arm 6, similarly the magnitude of the resultant force T at rolling conditions will vary. In the example illustrated, the value of the resultant force T varies about 10–15%.

The amount of twist to the torsion bar 23 is represented by F, the angle of rotation of the crank structure 16 about its axis of rotation 17, and is proportional to the product of the resultant force T and the distance of its application (K) from the pivot axis 17. Through the application of generally accepted engineering principles, variations of the distance K when the position of the boom arm 5 is changed is substantially proportional to variation of the distance H as previously defined. Therefore, the degree of rotation, F, which is utilized to determine the critical rolling conditions may be determined independent of the position of the boom arm 6. In order to best achieve this result, it has been found that the pivot or oscillation axis 17 and the axis of rotation 15 of the pulleys 14 should lie in a common plane inclining downward with respect to the tractor support plane as to form an angle B of approximately 55%, but an angle between 30° and 70° is suitable.

Since the circular sector shaped plate 30 is connected through an appropriate linkage system to the end 23*a* of the torsion rod 23, the edge 33 of the plate 30 is rotated through an angle corresponding to the twist in the torsion bar 23. Therefore, for any degree of rotation of the plate 30 there is indicated a percentage between the moment applied to the tractor from the operative load P and the critical rolling load regardless of the pivotal or lateral position of the boom arm 6. Since such angular movement will be indicated both during static and dynamic loading conditions the anti-rolling signalling device 100 allows the machine operator to observe all such loading conditions and achieve a much more effective operation of the pipe layer.

Figure 7:
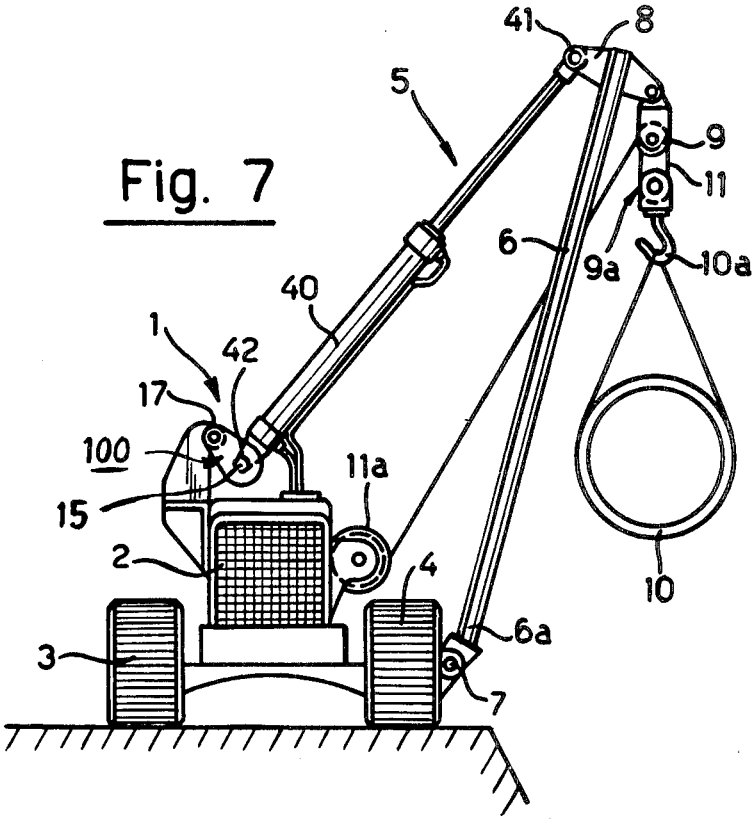
FIG. 7 is a front profile view of a mechanical schematic representation of a crawler tractor pipe layer showing the use of the anti-rolling signalling device with a hydraulic boom connection between the upright end of the side arm or lifting boom and the tractor frame.
Figure 4:
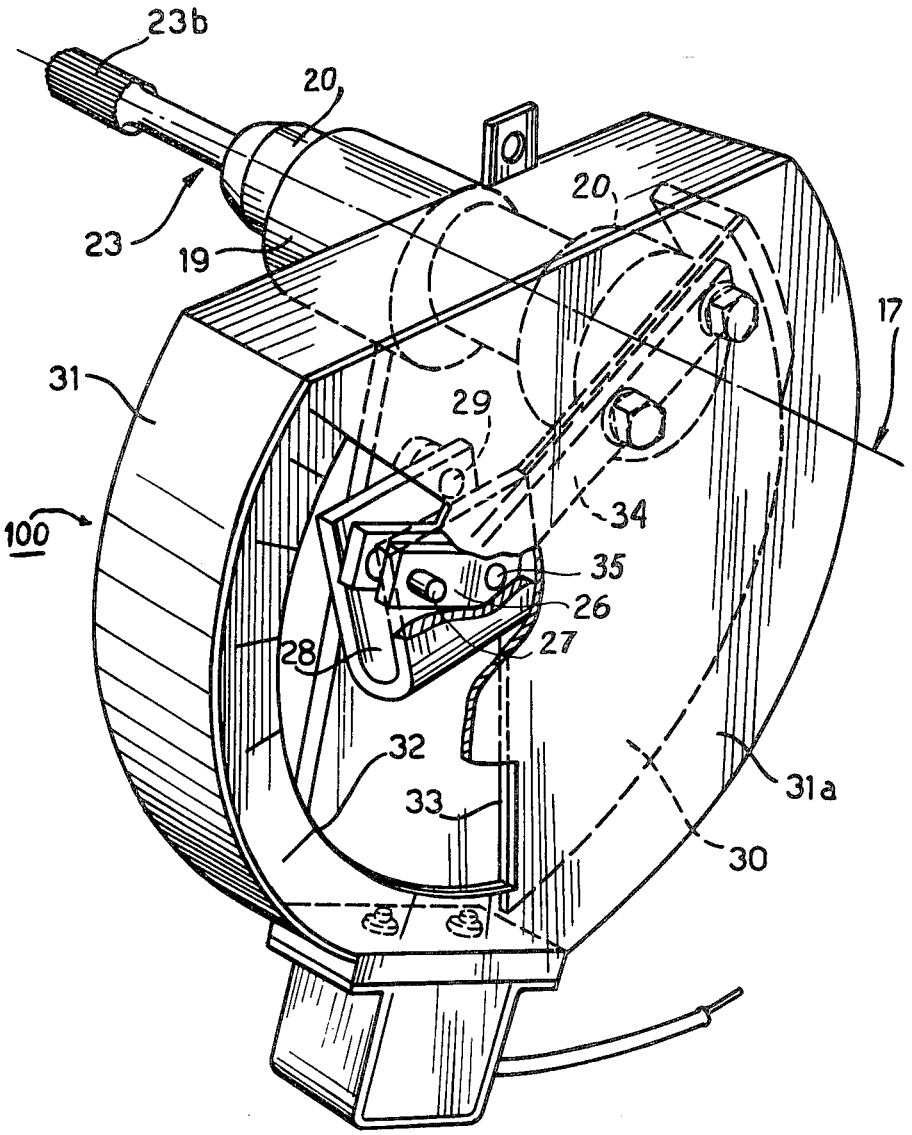
FIG. 4 is a perspective view of a portion of the anti-rolling signalling device to better illustrate the components thereof.
Figure 5:
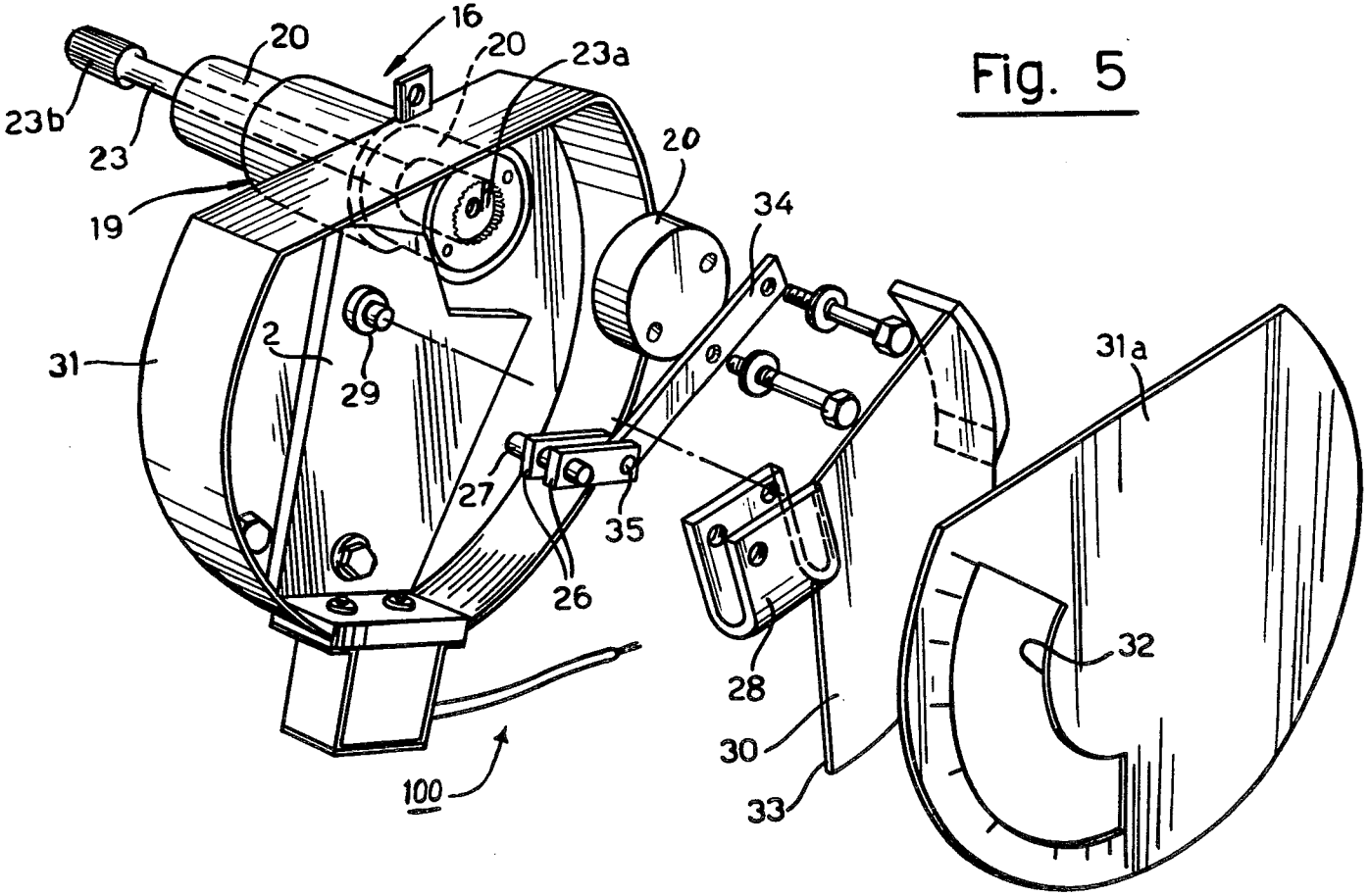
FIG. 5 is an exploded view of the anti-rolling signalling device shown in FIG. 4 to better illustrate the details thereof.

In the variant illustrated in FIG. 7, the pipe layer illustrated differs from that described with reference to FIGS. 1–6 only in the control of the lifting boom 6. In FIG. 7 the lifting boom 6 is controlled by a hydraulic actuator 40 instead of the pulley system previously described. The hydraulic actuator, as is well known, is pivoted at one end 41 to the side boom frame 8 and is connected at its opposite end 42, in the exaggerated manner as shown in FIG. 1, to the crank structure 16 as previously described. All remaining details of the pipe layer illustrated in FIG. 7 are identical to those of the pipe layer illustrated in FIGS. 1–6 and are indicated as the same numbers.

While the invention has been described with reference to a preferred embodiment, and a variant thereof, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention and that the invention will include all embodiments falling within the scope of the appended claims.

What is claimed is:

1. A display device for showing the magnitude of an applied loading force in relationship to the maximum load force to be applied including applied load force receiving means for receiving a directed force of a magnitude determined by a load applied thereto, pivotal support means carrying said applied load force receiving means and having a center of rotation offset radially from the point at which the directed force is applied for effecting pivotal movement in response to the magnitude of the applied load force, torque reacting means coupled to said pivot support and having a first end thereof fixedly secured against movement and a second end thereof fixed to said pivot support means for rotational movement therewith to effect a torsional loading of said torque reacting means in response to a load applied thereto by said applied load force receiving means, and linkage means connected to said torque reacting means for displaying the amount of torsional loading thereof.

2. The apparatus of claim 1 further including indicia bearing means positioned adjacent said linkage means and bearing indicia representing the maximum load force to be applied to said applied force receiving means such that the torsional loading of said torque reacting means effected by said applied load force can be compared to a maximum load force to be applied to said applied load force receiving means.

3. The apparatus of claim 1 wherein said torque reacting means and said pivot support are coaxial.

4. In a self-propelled pipe-laying machine including an applied load coupling lifting boom connected at one end to the pipe-laying machine for pivotal movement relative thereto and a counter-balancing coupling extending between the pipe-laying machine and a free end of the lifting boom for balancing the loading force applied to the lifting boom during pipe laying, the improvement comprising torque responsive means fixed at one end to the pipe-laying machine and connected at another end to the counter-balancing coupling at a point radially offset from the torque axis thereof such that the balancing load applied to the lifting boom during pipe laying will effect a torsional load on said torque responsive means as determined by the magnitude of an applied load, said torque responsive means including a torque reacting element responsive to the torsional load, and indicator means operatively connected to said torque reacting element for displaying the torsional load applied by the lifting boom during pipe laying.

5. In a self-propelled pipe-laying machine including an applied load coupling lifting boom connected at one end to the pipe-laying machine for pivotal movement relative thereto and a counter-balancing coupling extending between the pipe-laying machine and a free end of the lifting boom for balancing the loading force applied to the lifting boom during pipe laying, the improvement comprising torque responsive means fixed at one end to the pipe-laying machine and connected at another end to the counter-balancing coupling at a point radially offset from the torque axis thereof such that the balancing load applied to the lifting boom during pipe laying will effect a torsional load on said torque responsive means as determined by the magnitude of an applied load, indicator means operatively connected to said torque responsive means for displaying the torsional load applied by the lifting boom during pipe laying, and said torque responsive means includes a crank mechanism having an oscillation axis coaxial with a torsion bar which is fixedly connected thereto such that rotation of said crank mechanism applies a torsional load to said torsion bar.

6. The apparatus of claim 5 wherein said indicator means includes linkage amplifying the torsional movement of said torsion bar and means for comparing the torsional movement of said torsion bar with a predetermined torsional movement indicative of a maximum loading force.

7. A pipe laying vehicle having a load supporting and maneuvering assembly associated therewith, comprising load bearing boom means for supporting a load depending from one end thereof and pivotal relative to the pipe-laying vehicle, said load bearing boom means exerting a downward pivotal force which applies a rolling moment to said pipe-laying vehicle when a load is applied to said one end thereof, means for resisting downward pivotal movement of said load bearing boom means under the force created by a load on said one end thereof, said movement resisting means including a pivotal lever arm having a fixed pivot axis, means fixedly coupled to the pivotal lever arm for resisting pivotal movement thereof about said pivot axis, and means for indicating the angular deflection of said lever arm about said pivot axis in response to the force applied by said supported load, and means for comparing the angular deflection of said lever arm with a predetermined angular deflection such that the magnitude of the downward pivotal force created by the load coupled to said load bearing boom means is indicated by the angular deflection of said lever arm for warning a vehicle operator that forces approaching a given vehicle rolling moment are being applied.

8. A pipe-laying vehicle having a load supporting and maneuvering assembly associated therewith, comprising load bearing boom means for supporting a load depending from one end thereof and pivotable relative to the pipe-laying vehicle, said load bearing boom means exerting a downward pivotal force which applies a rolling moment to said pipe-laying vehicle when a load is applied to said one end thereof, means for resisting downward pivotal movement of said load bearing boom means under the force created by a load on said one end thereof, said movement resisting means including a pivotal lever arm having a fixed pivot axis, means for resisting pivotal movement of said lever arm about said pivot axis, and means for indicating the angular deflection of said lever arm about said pivot axis in response to the force applied by said supported load, means for comparing the angular deflection of said lever arm with a predetermined angular deflection such that the magnitude of the downward pivotal force created by the load coupled to said load bearing boom means is indicated by the angular deflection of said lever arm for warning a vehicle operator that forces approaching a given vehicle rolling moment are being applied, and said means for resisting pivotal movement of said lever arm comprises a torsion bar coaxial with said pivotal lever arm pivot axis and fixedly secured to said lever arm for receiving a torsion force applied therethrough.

9. The apparatus of claim 8 further including linkage means coupled to said torsion bar for amplifying the movement thereof.

10. The apparatus of claim 8 wherein said means for resisting downward pivotal movement of said load bearing means and said means for resisting pivotal movement of said lever arm are coplanar.

11. The apparatus of claim 10 wherein said common plane extends downwardly from a pipe-laying vehicle support plane from approximately 30° to approximately 70°.

12. The apparatus of claim 11 wherein said plane is approximately 55°.

* * * * *